US010392741B1

(12) United States Patent
Adamczyk

(10) Patent No.: US 10,392,741 B1
(45) Date of Patent: Aug. 27, 2019

(54) CLOTHES DRYER HAVING SPEED SENSOR

(71) Applicant: Sisler & Associates, LLC, Marion, OH (US)

(72) Inventor: Joseph H. Adamczyk, St. Charles, IL (US)

(73) Assignee: Sisler & Associates, LLC, Marion, OH (US)

( * ) Notice: Subject to any disclaimer, the term of this patent is extended or adjusted under 35 U.S.C. 154(b) by 213 days.

(21) Appl. No.: 15/415,677

(22) Filed: Jan. 25, 2017

Related U.S. Application Data

(60) Provisional application No. 62/288,684, filed on Jan. 29, 2016.

(51) Int. Cl.
*D06F 58/06* (2006.01)
*D06F 58/08* (2006.01)
*D06F 58/28* (2006.01)

(52) U.S. Cl.
CPC ..... *D06F 58/28* (2013.01); *D06F 58/06* (2013.01); *D06F 58/08* (2013.01); *D06F 2058/289* (2013.01); *D06F 2058/2854* (2013.01); *D06F 2058/2877* (2013.01); *D06F 2058/2887* (2013.01)

(58) Field of Classification Search
CPC ..... D06F 58/28; D06F 58/06; D06F 58/08; D06F 2058/2854; D06F 2058/2877; D06F 2058/2887; D06F 2058/289
USPC ..... 34/482
See application file for complete search history.

(56) References Cited

U.S. PATENT DOCUMENTS 3,890,719 A * 6/1975 Braga ..... D06F 58/08 345/572
4,300,293 A * 11/1981 Gladysz ..... D06F 58/08 34/108
4,488,363 A * 12/1984 Jackson ..... D06F 58/08 34/572
4,765,092 A * 8/1988 Cline ..... A01C 1/02 47/61

(Continued)

FOREIGN PATENT DOCUMENTS

DE 102004055940 A1 * 5/2006 ..... D06F 58/08
DE 102007046068 B4 * 6/2018 ..... D06F 58/08

(Continued)

*Primary Examiner* — Stephen M Gravini
(74) *Attorney, Agent, or Firm* — Robert C. Freed; Dykema Gossett PLLC

(57) ABSTRACT

A clothes dryer having a control circuit including a speed sensor, wherein the control circuit can sense movement of a portion of a drum assembly. The control circuit uses sensed speed information to control the motor, the heater, or other portion of the clothes dryer. While conventional components can provide a simple speed-triggered on-off switch for the motor or the heater, the present speed sensor approach can provide additional functions by discriminating between varying speeds. The speed sensor can also provide improved accommodation of a broken or slipping drive belt or other drive system problems by sensing the speed of a portion of the drum assembly rather than the motor speed. The speed sensor can replace the functions of multiple conventional components, simplifying the construction and reducing cost. The speed sensor can incorporate a solid state component which has lower cost and improved reliability over standard approaches.

8 Claims, 10 Drawing Sheets

(56) References Cited

U.S. PATENT DOCUMENTS

| | | | | |
|---|---|---|---|---|
| 6,327,994 | B1 * | 12/2001 | Labrador | B01D 61/10 114/382 |
| 6,941,679 | B1 * | 9/2005 | Harris | D06F 37/42 34/596 |
| 7,207,124 | B2 * | 4/2007 | Kim | D06F 37/304 200/61 |
| 7,536,807 | B2 * | 5/2009 | Baier | D06F 58/08 34/601 |
| 7,609,491 | B2 * | 10/2009 | Johnson | D06F 28/08 34/524 |
| 7,992,321 | B2 * | 8/2011 | Ricklefs | D06F 58/06 116/67 R |
| 8,046,933 | B2 * | 11/2011 | Yoo | D06F 58/08 34/599 |
| 8,256,139 | B2 * | 9/2012 | Morrison | D06F 58/28 34/413 |
| 2005/0016013 | A1 * | 1/2005 | Bang | D06F 58/08 34/486 |
| 2010/0132219 | A1 * | 6/2010 | Etemad | D06F 58/08 34/499 |
| 2013/0232813 | A1 * | 9/2013 | Heo | D06F 58/28 34/515 |
| 2015/0096191 | A1 * | 4/2015 | Jung | D06F 58/206 34/493 |
| 2018/0030645 | A1 * | 2/2018 | Kulkarni | D06F 58/22 |
| 2018/0266042 | A1 * | 9/2018 | Worley | D06F 58/28 |

FOREIGN PATENT DOCUMENTS

| | | | | |
|---|---|---|---|---|
| EP | 1672113 | A2 * | 6/2006 | D06F 37/304 |
| KR | 101139246 | B1 * | 5/2012 | D06F 37/304 |

* cited by examiner

CLOTHES DRYER HAVING SPEED SENSOR

CROSS-REFERENCES TO RELATED APPLICATIONS

The present application claims benefit of Provisional U.S. Patent Application Ser. No. 62/288,684, filed Jan. 29, 2016, which is hereby incorporated herein by reference.

BACKGROUND

Field of the Invention

The present invention pertains generally to clothes dryers. The present invention relates particularly to forced-air heated rotating drum clothes drying machines. More particularly, the invention relates to control mechanisms for such forced-air heated rotating drum clothes drying machines that enable dryer functions depending on movement of a portion of a drum assembly.

Description of the Prior Art

Typical clothes dryers have a rotating drum where wet clothes are placed in order to be dried after being washed. A motor rotates the drum, generally with a belt drive system. As the dryer drum rotates, the clothes rotate within the drum and tumble over themselves as hot air is circulated through the drum. The drum may rotate in one direction, and, in some machines, may periodically change directions. Hot air is circulated through the drum after passing through a heater, which can have an electrical heating element, or a gas fueled combustion heater, which warms the air. The hot dry air circulating through the rotating drum causes moisture from the clothes to evaporate into the air. The moisture ladened air either passes through a condenser, which removes moisture from the air before the air is recirculated into the dryer, or exits from the dryer through an exhaust. Some combined washer-dryer machines incorporate the drying features and functions just described.

The present invention provides improvements that address limitations associated with the prior art.

SUMMARY OF THE INVENTION

According to embodiments of the present invention provides a rotating drum clothes dryer, comprising a drum assembly, the drum assembly including a drum, wherein the drum is rotatable; a motor, wherein the motor is constructed and arranged to rotate the drum; a heater; and a control circuit including a speed sensor; wherein the control circuit is constructed and arranged to: sense movement of a portion of the drum assembly selected from the group consisting of the drum, a belt, an idler, a drum support roller, a drum bearing, a drum shaft, a belt tensioning roller and a sensor tag; and provide electrical control of an element of the clothes dryer requiring electrical inputs; wherein the element of the clothes dryer requiring electrical inputs is selected from the group consisting of the motor, the heater, a door lock, a visual indicator, an audible indicator, a timer and a fault detection indicator; wherein the sensed movement of the selected portion of the drum assembly is selected from the group consisting of the existence of movement and the speed of movement. In preferred embodiments, when the sensed movement of the selected portion of the drum assembly is the speed of movement, the control circuit can measure the speed to determine whether the movement is 1) at or above a predetermined speed threshold; or 2) below the predetermined speed threshold; wherein the control circuit is preferably constructed and arranged to actuate an operation of one or more of the elements of the clothes dryer requiring electrical inputs. In preferred embodiments, the speed sensor is selected from the group consisting of a solid-state sensor, an optical sensor, a magnetic sensor and a mechanical sensor. In further preferred embodiments, when the sensed movement of the selected portion of the drum assembly is the speed of movement; the control circuit will preferably provide a variable electrical power output to the motor to keep the magnitude of the speed of movement within a predetermined range. In preferred embodiments, the control circuit is further constructed and arranged to send electrical inputs to actuate one or more selected elements of the clothes dryer requiring electrical inputs. In further preferred embodiments, the control circuit can sense whether a portion of the drum assembly is moving at a speed that is selected from the group consisting of 1) a first speed at or above a first predetermined speed threshold; and 2) a second speed below the first predetermined speed threshold; wherein the control circuit is further constructed and arranged to actuate an operation of the selected element of the clothes dryer requiring electrical input. In alternate embodiment, the heater is preferably selected from the group consisting of an electrical resistance heater and a combustion heater and the speed sensor is preferably selected from the group consisting of a solid-state sensor, an optical sensor, a magnetic sensor and a mechanical sensor. The control circuit will preferably have an output signal that is an electrical signal and the motor includes a run winding and a start winding; wherein the control circuit is constructed and arranged to supply electrical power to the run winding and the start winding when the speed sensed by the control circuit is the second speed; and the control circuit is constructed and arranged to supply electrical power to the run winding, but not to the start winding, when the sensed speed is the first speed, wherein the control circuit is preferably constructed and arranged to turn on the heater when the selected portion of the drum assembly is sensed to be moving at the first speed and to turn off the heater when the control circuit senses that the selected portion of the drum assembly is moving at a third speed that falls below a second predetermined speed threshold which is below the first speed threshold. In further preferred embodiments, the control circuit is preferably constructed and arranged such that, when the speed sensed by the control circuit is the second speed, the control circuit initiates an action selected from the group consisting of turning on a broken belt indicator, turning on a slipping belt indicator, turning off the heater, disabling a switch for turning the heater on so that the heater cannot be turned on and turning off the motor. In alternate embodiments, when the selected portion of the drum assembly is moving at the first speed; the speed sensor is preferably constructed and arranged to sense the movement of the selected portion of the drum assembly and create a variable electrical output signal.

According to preferred embodiments of the present invention, the rotating drum clothes dryer preferably comprises a drum assembly including a rotatable drum, a motor constructed and arranged to rotate the drum, a heater, a control circuit, and a speed sensor constructed and arranged to: 1) sense whether a portion of the drum assembly is moving at a speed of movement that is selected from the group consisting of 1) a first speed at or above a first predetermined speed threshold; and 2) a second speed below the first predetermined speed threshold; wherein the portion of the drum assembly is selected from the group consisting of the drum, a belt, an idler, a drum support roller, a drum bearing, a drum shaft, a belt tensioning roller and a sensor tag; and 2) create an output signal to the control circuit that indicates whether the selected portion of the drum assembly is moving at a speed selected from the group consisting of the first speed and the second speed; wherein the control circuit is constructed and arranged to control the operation an element of the clothes dryer selected from the group consisting of the motor, the heater, a door lock, a visual indicator, an audible indicator, a timer and a fault detection indicator. In preferred embodiments, the motor includes a run winding and a start winding; wherein the speed sensor has an output signal that is an electrical signal and the motor includes a run winding and a start winding; the control circuit is constructed and arranged to supply electrical power to the run winding and the start winding when the speed sensed by the speed sensor is the second speed; and the control circuit is constructed and arranged to supply electrical power to the run winding, but not to the start winding, when the speed sensed by the speed sensor is the first speed. In further preferred embodiments, where the motor requires an electrical power input; the control circuit is constructed and arranged to provide a variable electrical power input to the motor; and the speed sensor can sense a magnitude of a third speed of the portion of the drum assembly and create a variable output signal to the control circuit that corresponds to the magnitude of the third speed; the control circuit is preferably constructed and arranged to vary the electrical power provided to the motor so as to provide sufficient electrical power to the motor to keep the third speed within a predetermined range. In further preferred embodiments, the control circuit is constructed and arranged to turn on the heater when the speed of movement is the first speed and turn off the heater when the control circuit senses that the selected portion of the drum assembly is moving at a third speed that falls below a second predetermined speed threshold which is below the first speed threshold. In alternate embodiments, the control circuit is constructed and arranged such that, when the speed sensed by the speed sensor is the second speed, the control circuit initiates an action selected from the group consisting of turning on a broken belt indicator, turning on a slipping belt indicator, turning off the heater, disabling a switch for turning the heater on so that the heater cannot be turned on and turning off the motor. The speed sensor is preferably selected from the group consisting of a solid-state sensor, an optical sensor, a magnetic sensor, and a mechanical sensor and the heater is preferably selected from the group consisting of an electrical resistance heater and a combustion heater.

The present invention also provides methods of actuating an element of a rotating drum clothes dryer that requires electrical inputs; wherein the element of the rotating drum clothes dryer that requires electrical inputs is selected from the group consisting of a motor, a heater, a door lock, a visual indicator, an audible indicator, a timer and a fault detection indicator; the method preferably comprising the steps of: 1) providing a rotating drum clothes dryer, comprising a drum assembly, the drum assembly including a drum, wherein the drum is rotatable; a motor, wherein the motor is constructed and arranged to rotate the drum; a heater; and a control circuit including a speed sensor; wherein the control circuit is constructed and arranged to: sense movement of a portion of the drum assembly selected from the group consisting of the drum, a belt, an idler, a drum support roller, a drum bearing, a drum shaft, a belt tensioning roller and a sensor tag; and provide electrical control of an element of the clothes dryer requiring electrical inputs; wherein the element of the clothes dryer requiring electrical inputs is selected from the group consisting of the motor, the heater, a door lock, a visual indicator, an audible indicator, a timer and a fault detection indicator; wherein the sensed movement of the selected portion of the drum assembly is selected from the group consisting of the existence of movement and the speed of movement; 2) sensing movement of the selected portion of the drum assembly; and 3) sending an electrical input to the selected element of the clothes dryer to actuate an operation of the selected element of the clothes dryer.

In another embodiment, the present invention preferably includes a clothes dryer having a speed sensor for sensing the speed of movement of a portion of a drum assembly.

In yet another example embodiment, the present invention preferably includes a clothes dryer having a movement sensor for sensing movement of a portion of a drum assembly and communicating the sensed movement to a control circuit.

In still another example embodiment, the present invention preferably includes a method of controlling a selected element of a clothes dryer.

One key aspect and feature of the present invention is a speed sensor that senses movement of a selected portion of a drum assembly of a clothes dryer and has a variable output signal that depends on the sensed movement.

Another key aspect and feature of the present invention is a control circuit that has the output signal of a drum assembly speed sensor as an input and controls a portion of the clothes dryer in a way that corresponds to the output signal of the speed sensor. In preferred embodiments, a clothes dryer having a control circuit including a speed sensor is provided, wherein the control circuit can sense movement of a portion of a drum assembly. The control circuit uses the sensed speed information to control the motor, the heater, or other portion of the clothes dryer. While conventional components can provide a simple speed-triggered on-off switch for the motor or the heater, the present speed sensor approach can provide additional functions by discriminating between varying speeds. The speed sensor can also provide improved accommodation of a broken drive belt or a slipping drive belt or other drive system problems by sensing the speed of a portion of the drum assembly rather than the motor speed. The speed sensor can replace the functions of multiple conventional components, simplifying the construction and reducing cost. The speed sensor can incorporate a solid state component which has lower cost and improved reliability over standard approaches.

A further key aspect and feature of the present invention is the control of a portion of a clothes dryer by using the output signal of a speed sensor that senses movement of a portion of a drum assembly.

Having thus briefly described some illustrative embodiments of the present invention, and having mentioned some significant aspects and features of the present invention, it is the principal object of the present invention to provide apparatus and methods for controlling the operation of a clothes dryer by sensing movement of a selected portion of the preferred drum assembly.

Another object of the present invention is to provide apparatus and methods for monitoring the movement of a selected portion of the drum assembly of such a clothes dryer.

These and various other advantages and features of novelty which characterize the present invention are pointed out with particularity in the claims annexed hereto and forming a part hereof. However, for a better understanding of the invention, its advantages and objects obtained by its use, reference should be made to the drawings which form a further part hereof, and to the accompanying descriptive matter, in which there is illustrated and described a preferred embodiment of the present invention.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION

Figure 1A:
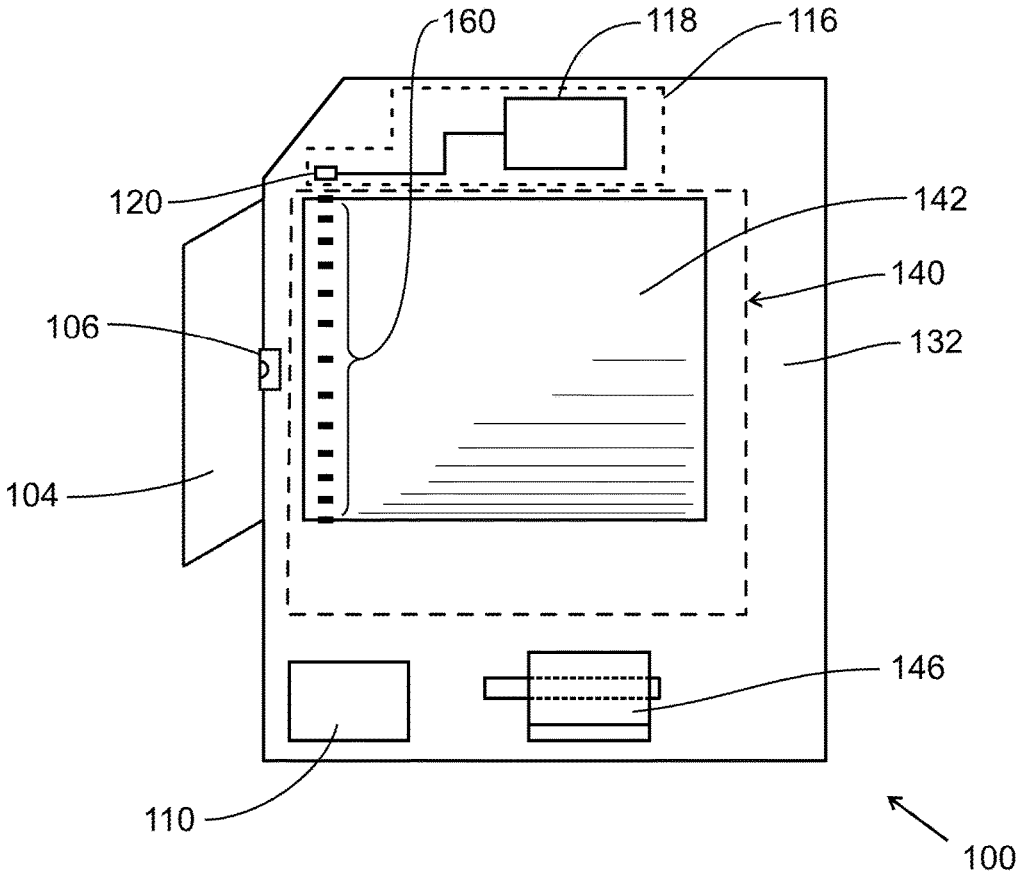
FIG. 1A is a schematic illustration of a preferred embodiment of the present invention showing a clothes dryer with a drum assembly, a motor, a heater, a control circuit preferably including a movement sensor or speed sensor.

Clothes dryers are commonly used for drying wet clothes and other items and materials after washing. The present invention addresses limitations of clothes dryers.

Typical clothes dryers have a rotating drum where wet clothes are placed after washing. A motor rotates the drum, usually through a belt drive system. As the dryer drum rotates, the clothes are turned over and tumble around. The drum may rotate in one direction, or periodically change directions. Air is drawn into the machine and passes through a heater, which can have an electrical heating element, or a combustion heater, for example, which warms the air. Hot dry air is blown into the rotating drum, typically by a blower, and water evaporates from the wet clothes. The moist air either passes through a condenser which removes moisture from the air which then can be recirculated back into the dryer, or exits from the dryer through an exhaust. In some situations, a combined washer-dryer machine incorporates the drying features and functions as just described.

In some prior clothes dryers, a centrifugal switch is located on the motor drive shaft. When the drive shaft spins fast enough, a mass overcomes a spring in the centrifugal switch, and an electrical switch is actuated to open the motor start winding circuit, or to close a heater power circuit. A shortcoming of this approach is that the centrifugal switch can allow the heater to operate when the motor is running, even if the drum is not rotating as intended. For example, with a belt drive system, as is common in clothes dryers, if the belt were slipping or broken, the drum would not rotate properly even when the motor is running at the desired speed. In this approach, in order to prevent the motor and the heater from operating when a belt has broken, a separate "broken belt switch" is sometimes used. Another shortcoming with the centrifugal switch approach is that if the motor stalls or is slowed by a heavy drum load, the motor start winding can continue to cycle on and off. The centrifugal switch, and the broken belt switch are mechanical components with moving parts, and have cost, complexity, and reliability issues.

The present invention includes a speed sensor which is constructed and arranged to sense movement of an element of a drum assembly of a clothes dryer. The drum assembly includes a rotatable drum into which the material to be dried is placed. Depending on the particular configuration of the clothes dryer, the drum assembly can include other components associated with the rotation of the drum, such as a belt, one or more pulleys, followers, tensioners, support rollers, bearings, and so forth. In other configurations, the drum assembly can include gears or other means of transferring motive force from the motor to the drum to effect the rotation of the drum. While a belt drive system is more common in clothes dryers, a direct drive or a geared drive system can be used.

Occasionally, there are problems with the drum assembly or the drive system, and the drum does not rotate as desired. The drum may rotate too slowly, for example, or rotate intermittently, or otherwise not as desired, or not rotate at all. For example, a belt can be broken or loose and slipping, or the drum, a bearing, a gear or other hardware can be broken or worn, so that the drum does not rotate as intended. In addition, the motor itself can be defective, and not provide the required motion to the drum assembly. If the drum does not rotate properly, the clothes (or other material to be dried) in the drum may not be moved around and tumbled effectively, resulting in poor drying, or in overheating of portions of the material. Such overheating can cause damage to the material, and can present a safety hazard.

Clothes dryers typically include a control system or control circuit, with various electrical and electronic components that control the operation of the clothes dryer, such as starting or stopping a timer, adjusting the operating duration, the temperature or power of the heater, adjusting the rotation speed of the drum, the power or speed of the motor, or temperature of the heated air, locking or unlocking the dryer door, actuating visual or audible indicators to communicate status to the user.

The present invention includes a speed sensor that is constructed and arranged to sense movement of a portion of the drum assembly. For example, the speed sensor may be configured to detect the movement or non-movement, or magnitude or speed or velocity of movement, of the drum, a belt, a pulley, a follower, an idler, a tensioner, a gear, a shaft, a support roller, or other portion of the drum assembly. The speed sensor senses the movement of the portion of the drum assembly, and has an output signal which corresponds to the sensed movement. In some embodiments, the control circuit incorporates the speed sensor, and the output signal is communicated within the control circuit. In other embodiments, the speed sensor is distinct from the control circuit, and the output signal of the speed sensor is communicated to the control circuit. The control circuit controls a portion of the clothes dryer according to the output signal of the speed sensor. For example, if the speed sensor senses that the drum, or the belt, or another portion of the drum assembly, is not moving, the control circuit could turn off the heater, or prevent the heater from turning on, or signal the user. In another example, if the speed sensor senses that the speed of movement of the drum or another portion of the drum assembly is below a predetermined threshold speed, the control circuit could supply electrical power to a start winding and a run winding of the motor. In yet another example, if the speed sensor senses that the speed of movement of the drum or another portion of the drum assembly is above a predetermined threshold speed (which may be different that the threshold just mentioned), the control circuit could supply electrical power to a run winding but not a start winding of the motor.

The present invention requires fewer moving parts than the prior centrifugal switch approach, allowing for improving reliability, reduced complexity and reduced cost. These and other useful advantages and improvements of the present invention are further described herein.

Figure 1B:
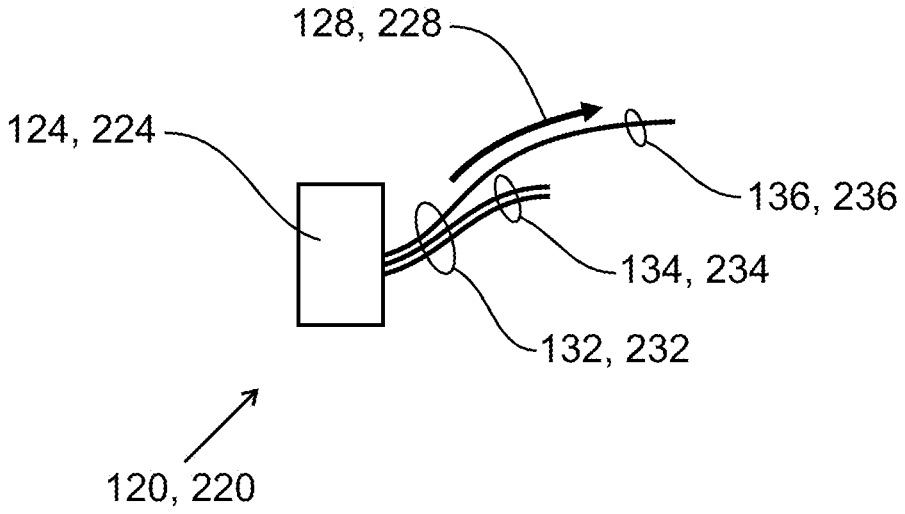
FIG. 1B is a schematic illustration showing a speed sensor for sensing movement of a portion of the drum assembly of FIG. 1A.
Figure 1C:
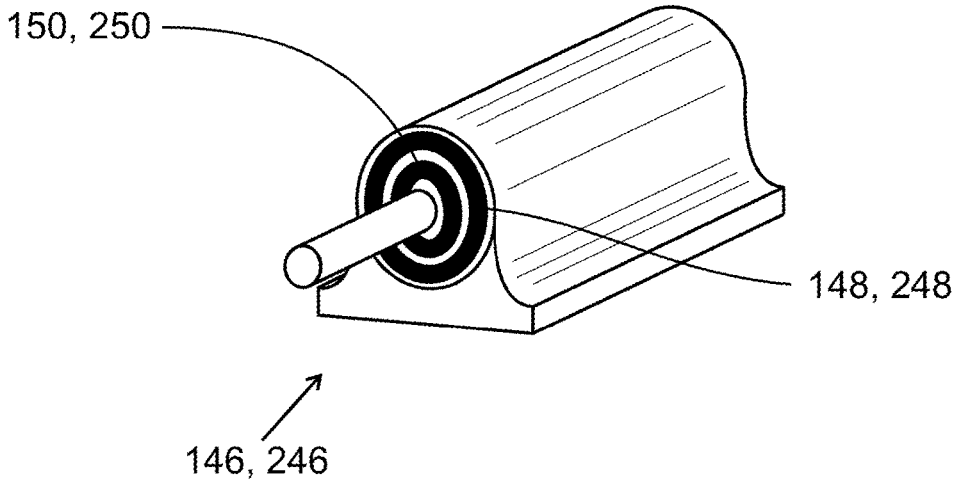
FIG. 1C is a schematic illustration showing a motor having a start winding and a run winding controlled by a control circuit according to the output of the speed sensor of FIG. 1B.

Turning now to FIGS. 1A-1C, FIG. 1A is a schematic illustration showing a clothes dryer 100 with a drum assembly 140, a heater 110, a motor 146, a control circuit 116, and incorporating a speed sensor or movement sensor 120. The drum assembly 140 includes a drum 142, which is rotatable. The motor 146 rotates the drum 142. Heater 110, which can be an electrical heater or a combustion heater, for example, heats air which passes into the drum 142. The speed sensor 120 is configured and arranged to sense movement of a portion of the drum assembly 140. The speed sensor 120 can sense the existence or presence or absence of movement, or the rotational speed, rotational velocity, translational speed, or translational velocity, direction of movement, or revolutions per minute (RPM) of rotation, or a combination, for example, of a portion of the drum assembly 140. For example, speed sensor 120 can be configured and arranged to sense the RPM of the drum 142.

The drum 142 has an opening for placement of clothes or other materials to be dried, and the drum 142 rotates to tumble the materials as warm air is passed through the drum to dry the materials. The drum 142 is rotatable by the motor 146. As further illustrated in the schematic illustration of FIG. 1C, the motor 146 typically has a run winding 150 which when supplied with electrical power maintains the motor 146 at an operational speed; the motor 146 optionally includes a start winding 148 which when supplied with electrical power applies additional start-up capacity so the motor 146 can come up to speed. In some embodiments, the motor 146 preferably has a variable speed or power, and the control circuit 116 preferably can provide variable power input to the motor 146; for example, the control circuit 116 preferably can provide variable voltage, current, or frequency to the motor 146 in order to adjust the speed of the motor 146. The heater 110 is preferably configured and arranged to warm air, and can be an electrical heater, a combustion heater, a heat pump or other known heating elements or combinations. The warm air warms and dries the clothes as they tumble in the rotating drum 142. A door 104 closes to contain the clothes in the drum; an optional door lock 106 may be provided for user safety during operation.

Figure 2A:
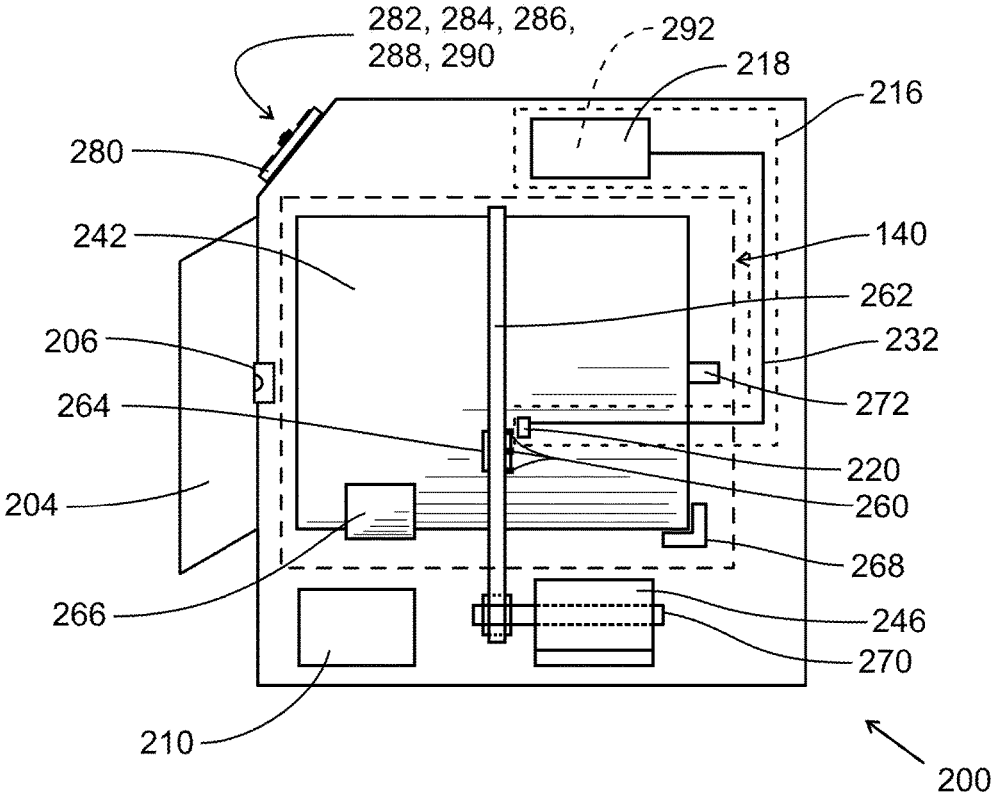
FIG. 2A is a schematic illustration of embodiments of the present showing a clothes dryer with a heater, a motor, a control circuit, a speed sensor, a drum assembly having a belt drive, and additional elements of the preferred clothes dryer that can be controlled by the control circuit.

The control circuit 116 preferably includes various electrical and electronic components 118 that control the operation of the clothes dryer 100, such as adjusting the operating duration, the temperature or power of the heater 110, the rotation speed of the drum 142, the power or speed of the motor 146, the temperature of the heated air, or the locking of the dryer door 104; the control circuit 116 may actuate optional visual or audible indicators to communicate status to the user or maintenance personnel (see FIG. 2A for examples). The control circuit 116 controls the portions of the clothes dryer 100 via connections or communication paths such as electrical wires; the electrical wires are not shown in the figures for clarity of illustration.

As further illustrated in the schematic illustration of FIG. 1B, the speed sensor 120 can utilize magnetically-, electrically-, or optically-based sensing, for example. Preferably, the speed sensor 120 utilizes a solid state sensor element 124 to improve the reliability and longevity of the movement sensor 120. Sensor element 124 is preferably a Hall-effect sensor, but an optical sensor element can be used, for example, or other sensor element can also be used, preferably solid state. An optical sensor element preferably can, for example, detect the breaking of a light beam. One or more LEDs or other light source preferably can be used, with a separate light sensor(s) that detects the presence or absence of light. Alternatively, combination emitter/receiver LED(s) preferably can be used, where light emitted from the LED is arranged to reflect back into the LED which then detects the presence or absence of this reflected light. The speed sensor 120 preferably communicates output 128 and receives any required electric power through communication path 132. Typically, positive and negative (or ground) electrical supply wires 134, and an electrical signal wire 136 are used for communication, although a fewer or greater number of wires can be used; further, electrical supply wires are not always required, and a signal can be communicated optically, for example. In some embodiments, the control circuit 116 preferably incorporates the speed sensor 120, and the output 128 is communicated within the control circuit 116. In other embodiments, the speed sensor 120 is preferably distinct from the control circuit 116, and the output 128 of the speed sensor 120 is communicated to the control circuit 116.

The drum assembly 140 preferably can include magnetic or optical portions or elements or sensor tags 160 which, when moved, can be easily sensed by the speed sensor 120; for example, a pattern of light and dark markings on the drum can facilitate sensing of drum movement by an optical sensor, or a number of magnets or ferromagnetic regions on the drum can facilitate sensing of drum movement by a magnetic sensor. Ridges, teeth, or other physical features can also be incorporated to facilitate sensing of movement by the speed sensor 120. Features that reflect light, or features that block light, can facilitate sensing by an optical sensor, for example. The speed sensor 120 can be configured and arranged to sense movement of the drum 142, or of any other portion of the drum assembly 140. While a solid state sensor is preferred, mechanical sensors or combinations of mechanical and solid state sensing elements can be utilized in some embodiments. Preferably, the speed sensor 120 uses non-contact sensing to reduce wear and improve reliability.

Speed sensor 120 has an output 128 which can be communicated via the communication path 132. Preferably, output 128 is an electrical signal. More preferably, output 128 is a variable electrical signal which has more than two possible values of a property such as voltage, current, or frequency. The output 128 can be an analog signal, such as a voltage that corresponds to the sensed movement. Such correspondence can be direct functional correspondence, as in a greater sensed movement produces a correspondingly larger magnitude of the output 128. Alternatively, such correspondence can be inverse, with a greater sensed movement producing a correspondingly smaller magnitude of the output 128. In another example, ranges of sensed movement such as speed above a predetermined level, or between multiple predetermined levels, produce corresponding magnitudes or frequency of the output 128. In yet another example, the output 128 can be a voltage that is proportional to the speed of rotation of the drum 142. The output 128 can be an electrical current that corresponds to the sensed movement, or an electrical signal with varying frequency, where the frequency corresponds to the sensed movement. The output 128 can alternatively be a digital signal that corresponds to the sensed movement. Various output signal types, including continuously variable analog, categorical (discrete ranges), and digital signals, and including voltage, current, frequency, resistance, impedance, and digitally converted or encoded signals can be utilized. The output 128 has at least two possible values; for example, one value when no movement is sensed, and another value when movement is sensed. In another example, the output 128 has one value when speed at or greater than a predetermined threshold speed is sensed, and another value when speed below a predetermined threshold is sensed. Preferably, the output 128 has more than two values, corresponding to more than two values of sensed movement, to indicate degree or magnitude of movement. These multiple sensed movement values could correspond to "moving below a start threshold", "moving above a start threshold but below a run threshold", and "moving above a run threshold" for example. In another example, multiple sensed movement values could correspond to "moving below a heater deactivation threshold", "moving above a heater deactivation threshold but below a heater activation threshold", and "moving above a heater activation threshold". Another sensed movement value, for example, is a "moving below a slipping belt threshold". One or more predetermined speed or movement thresholds can be used to characterize the sensed movement communicated by the speed sensor 120. A single predetermined speed threshold can be used, to distinguish whether the sensed speed of movement is at or above, or below, the threshold. Two or more predetermined speed thresholds can be used, to distinguish whether the sensed speed of movement is at or above, or below, each threshold, or whether the sensed speed of movement is within ranges defined by the thresholds. A pair of predetermined speed thresholds can be used, for example, to provide for activating a selected portion of the clothes dryer 100 when the sensed speed is at or above a first speed threshold, and deactivating the selected portion of the clothes dryer 100 when the sensed speed is below a second speed threshold which is below the first speed threshold, and to make no adjustment to the activation of the selected portion of the clothes dryer 100 when the sensed speed is at or above the second speed threshold and below the first speed threshold. This approach can be used, for example, to reduce the repeated cycling of the heater 110 or the motor start winding 148 to avoid premature failure of the selected portion of the clothes dryer 100 which could otherwise result from such repeated cycling. In other embodiments, the output 128 is a continuous variable that corresponds to the sensed movement as a variable, rather than a categorical quantity; for example, output 128 can be a voltage (or a current, or a frequency, or a digitally converted signal) proportional to the speed of rotation of the drum 142. Further, the same sensing and output signals just described can apply to any moving portion of the drum assembly 140, rather than the drum 142 as in the just-described examples.

FIG. 2A is a schematic illustration showing a clothes dryer 200 which is similar to the clothes dryer 100 of FIG. 1A, and wherein corresponding elements (numbered 2*nn* in FIGS. 2A-2B) are similar to those of FIG. 1A (numbered 1*nn* in FIGS. 1A-1C), but with additional elements and details as follows. The clothes dryer 200 has a drum assembly 240, a heater 210, a motor 246, a control circuit 216, and incorporating a movement sensor 220. The clothes dryer 200 typically includes user indicators and controls 280, which may include a slipping belt indicator 284, a broken belt indicator 286, a fault detection indicator 288, audible or other indicators 282, and/or a timer 290. These indicators and controls may be located at or near a front panel area for convenience as indicated in FIG. 2A; some indicators, such as audible indicators as described herein, may be located at other locations on or within the clothes dryer 200. The user indicators and controls 280 can also include various controls for choosing cycle parameters such as temperature, drum rotation speed, drying duration, and so forth. The drum assembly 240 includes a rotatable drum 242, and may include optional additional elements including a belt 262, an idler or idler wheel or belt tensioning roller 264, a drum support roller 266, a drum bearing 268, and a drum shaft 272. The speed sensor 220 is configured and arranged to sense movement of a portion of the drum assembly 240 and has an output 228; the output 228 of the speed sensor 220 is communicated via communication path 232. The control circuit 216 uses the output 228 of the movement sensor 220 to correspondingly control one or more portions of the clothes dryer 200. In some embodiments, the control circuit 216 controls the heater 210 by turning the heater on, turning the heater off, increasing or decreasing the heater output or operating temperature, based on whether the output 228 indicates that the speed of movement of the drum 242 is at or above, or below, one or more predetermined thresholds. In some embodiments, the control circuit 216 controls the motor 246 by turning the motor 246 on, turning the motor 246 off, increasing or decreasing the power or speed of the motor 246, or supplying power selectively to a start winding 248 or a run winding 250 or both a start winding 248 and a run winding 250. In some embodiments, the control circuit 216 actuates, activates, deactivates, adjusts, starts, stops, turns on, turns off, increases, decreases, or otherwise modulates or controls these or other portions of the clothes dryer which are present in some embodiments, including activating a slipping belt indicator 284, activating a broken belt indicator 286, locking or unlocking a door lock 206, starting, stopping, or otherwise adjusting a timer 290, activating a fault detection indicator 288, or updating a run log 292. The control circuit 216 preferably includes various electrical and electronic components 218 that control the operation of the clothes dryer 200, as described in reference to the control circuit 116. The control circuit 116, 216 can include a switch which allows the heater 110, 210 to be turned on, directly or through a relay, for example. Preferably, the control circuit 216 provides electrical control of one or more portions of the clothes dryer 200.

The drum 242 is typically supported by one or more drum support rollers 266, and may have one or more moving or rotating drum bearings 268. Clothes dryers that incorporate a belt drive system include a belt 262, and often include an idler or idler wheel or belt tensioning roller 264, a drum support roller 266, a drum bearing 268, a motor shaft 270, and may include a drum shaft 272. In some configurations, the drum can be driven by the motor 246 directly or through gearing (not shown) rather than a belt drive system. When present, the belt 262, the drum support roller(s) 266, the drum bearing 268, the drum shaft 272, and the idler wheel or belt tensioning roller 264 are portions of the drum assembly 240.

The speed sensor 220 of clothes dryer 200 is similar to the speed sensor 120 of clothes dryer 100 as previously described in reference to FIG. 1B, with a sensor element 224, output 228, communication path 232, electrical supply wires 234, and electrical signal wire 236 as illustrated in FIG. 1B. The speed sensor 220 is configured and arranged to sense movement of a portion of the drum assembly 240. The speed sensor 220 can sense the existence or presence or absence of movement, or the rotational speed, rotational velocity, translational speed, or translational velocity, direction of movement, or revolutions per minute (RPM) of rotation, or a combination, for example, of a portion of the drum assembly 240. For example, movement sensor 220 can be configured and arranged to sense the translational speed of the belt 262.

The motor 246 of clothes dryer 200 is similar to the motor 146 of clothes dryer 100 as previously described in reference to FIG. 1C, with a run winding 250 but optionally including a start winding 248, similar to the corresponding items as illustrated in FIG. 1B.

While the present invention is particularly useful in controlling the heater 210 and/or the motor 246, there are various other portions of the clothes dryer that can be controlled by the control circuit 216 in a manner that is enhanced by incorporation of the speed sensor 220 as described. For example, the speed sensor 220 can sense movement of a portion of the drum assembly 240 that is moving at a speed below a predetermined threshold for a predetermined duration of time, and the control circuit 216 can then activate a slipping belt indicator 284; a slipping belt indicator 284 can be a visual indicator on a display, or an audible indicator, for example. In another example, the speed sensor 220 can sense non-movement of a portion of the drum assembly 240 that is not moving for a predetermined duration of time, and the control circuit 216 can then activate a broken belt indicator 286; a broken belt indicator 286 can be a visual indicator on a display, or an audible indicator, for example. In yet another example, the speed sensor 220 can sense movement of a portion of the drum assembly 240 that is moving, and the control circuit 216 can then activate a door lock 206. In still another example, the speed sensor 220 can sense movement of a portion of the drum assembly 240 that is moving at a speed above or below a predetermined threshold or range for a predetermined duration of time, indicating an error or fault, and the control circuit 216 can then activate a fault detection indicator 288; a fault detection indicator 288 can be an indicator on a display, or an audible indicator, for example. In a further example, the speed sensor 220 can sense movement of a portion of the drum assembly 240, and the control circuit 216 can then record run information in a run log 292; a run log 292 can be electronic memory which stores information such as operating time, speeds, temperature, faults, or other diagnostic information for use in maintaining the clothes dryer, and accessible to the user and/or to maintenance or repair technicians. The run log 292 can be located at any convenient location within the clothes dryer 200; for example, the run log 292 can be located at or near other user indicators and controls 280, or at or near the control circuit 216, as indicated in FIG. 2A.

In some embodiments, the speed sensor 220 is a part of the control circuit 216. In this case the communication path 232, and the electrical signal wire 236 communicate the output 228 from the speed sensor 220 to other portions of the control circuit 216. In other embodiments, the speed sensor 220 is external to or distinct from the control circuit 216, and the communication path 232 and the electrical signal wire 236 communicate the output 228 from the speed sensor 220 to the control circuit 216.

In some embodiments, some electronic components of the control circuit 116, 216 are preferably located adjacent to or incorporated with the speed sensor 120, 220. In this case, some signal processing, such as electronic comparisons, analog to digital conversions, or other processing, can take place in or adjacent to the speed sensor 120, 220; the output 128, 228 which is communicated via the communication path 132, 232, can be a modified signal, modified by such processing. In other cases, all signal processing takes place in electronic components of the control circuit 116, 216 which are remote from the speed sensor 120, 220, and the output 128, 228 which is communicated via the communication path 132, 232, is an unprocessed signal. In still other cases, some signal processing can take place in or adjacent to the speed sensor 120, 220, and additional signal processing can take place in electronic components of the control circuit 116, 216 which are remote from the speed sensor 120, 220, and the output 128, 228 which is communicated via the communication path 132, 232, is a partially processed signal.

The control circuit 116, 216 controls a controllable portion of the clothes dryer 100, 200 as previously described via connections or communication paths such as electrical wires; the electrical wires are not shown in the figures for clarity of illustration. This control is preferably electronic control.

Figure 2B:
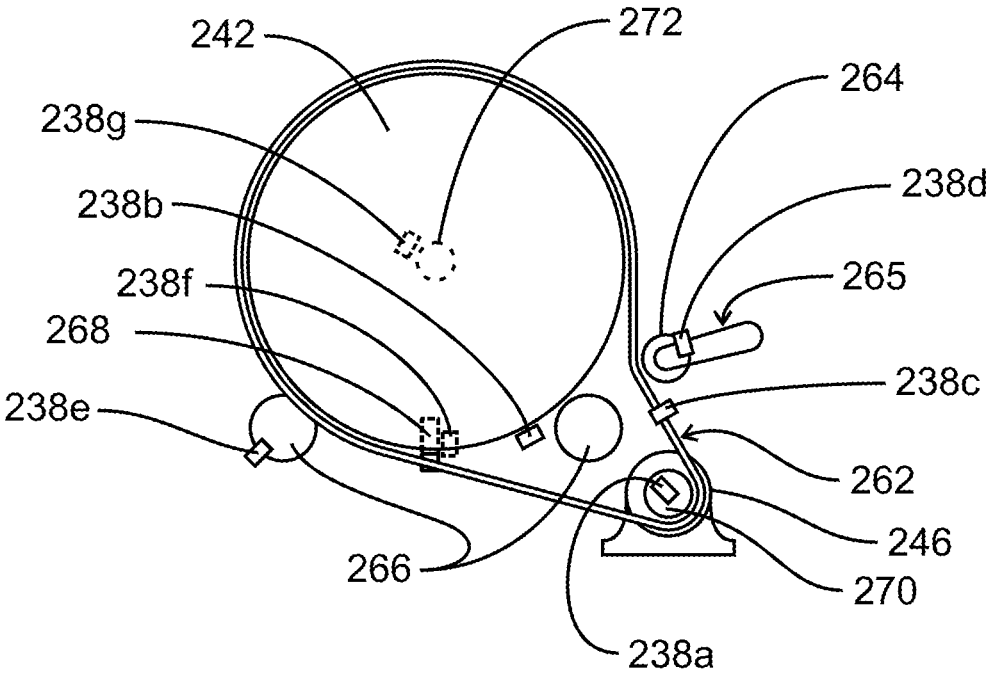
FIG. 2B is a schematic illustration showing the clothes dryer of FIG. 2A showing some example alternative locations of the speed sensor.

The speed sensor 220 is illustrated in FIG. 2A as being located at or near the drum 242; FIG. 2B illustrates some alternative locations for the speed sensor 220. These include being located at or near the drum 242, the idler wheel 264, the idler arm 265, the belt 262, the drum support roller 266, the drum bearing 268, or the drum shaft 272. The speed sensor 220 can be located, for example, at locations 238*b*-238*g*. Location 238*b* of the speed sensor 220 provides for sensing movement the drum 242, location 238*c*: for the belt 262, location 238*d*: for the idler wheel 264, location 238*e*: for the drum support roller 266, location 238*f*: for the drum bearing, location 238*g*: for the drum shaft 272. The speed sensor 220 can be configured and arranged to sense movement of any portion of the drum assembly 240 which moves together with the drum 242.

The drum assembly 240 can include magnetic or optical portions or elements or sensor tags 160 (FIG. 1A) which, when moved, can be easily sensed by the speed sensor 220; for example, a pattern of light and dark markings on the drum can facilitate sensing of drum movement by an optical sensor, or a number of magnets or ferromagnetic regions on the drum can facilitate sensing of drum movement by a magnetic sensor. Ridges, teeth, or other physical features can also be incorporated to facilitate sensing of movement by the speed sensor 220. For example, a belt 262 can be a toothed belt, and the belt teeth can facilitate sensing of movement by the speed sensor 220, particularly if the speed sensor has a sensor element 224 which is an optical sensor element. The speed sensor 220 can be configured and arranged to sense movement of the drum 242, or of any other portion of the drum assembly 240. While a solid state sensor is preferred, mechanical sensors or combinations of mechanical and solid state sensing elements can be utilized in some embodiments. Preferably, the speed sensor 220 uses non-contact sensing to reduce wear and improve reliability.

As described herein, the control circuit 116, 216 actuates, activates, modifies or modulates the operation of a portion of the clothes dryer 100, 200 dependent upon the value of the output 128, 228 of the speed sensor 120, 220. As described herein, such modulation can include activating or deactivating a light or buzzer, displaying information on an information panel, starting or stopping a motor, heater, blower, or timer, modifying a drying cycle time or temperature or drum rotation speed, locking or unlocking a door lock, updating a fault record or run log, and so forth.

The speed sensor 220 can be located at any convenient location, as long as the speed sensor 220 is configured and arranged to sense movement of a portion of the clothes dryer 200 that moves only when the drum 242 moves, and preferably, a portion of the clothes dryer 200 that moves faster or slower when the drum 242 moves faster or slower, in a corresponding fashion. For example, by monitoring the speed of movement of a portion of the clothes dryer 200 that moves only when the drum 242 moves, the control circuit 216 could determine that the drum 242 is accelerating to its typical operating speed more quickly or more slowly than normal, indicating the presence of some problem; by controlling various indicators 282 or a run log 292 as described herein, the user or maintenance personnel can be informed of the existence of a problem.

In some embodiments, the speed sensor 220 is a speed sensor can sense whether a portion of the drum assembly 240 is moving at a speed that is at or above a predetermined speed threshold, or below the predetermined speed threshold, and can create an output or output signal 228 that indicates whether the portion of the drum assembly 240 being sensed is moving at a speed which is at or above the predetermined speed threshold or below the predetermined speed threshold, and the control circuit 216 can control an element of the clothes dryer such as the motor 246, the heater 210, the door lock 206, or the visual or audible indicator 282 such as the slipping belt indicator 284, the broken belt indicator 286, the fault detection indicator 288.

In some prior clothes dryers, a centrifugal switch is located on a motor shaft or drive shaft, near location 238*a* (FIG. 2). When the drive shaft spins fast enough, a mass overcomes a spring in the centrifugal switch, and a mechanical switch is actuated to open a motor start winding electrical circuit, or to close a heater power circuit, either directly or via a relay or other circuitry. The centrifugal switch is a mechanical device having moving parts; reliability of such mechanical components can be problematic. Another shortcoming of this approach is that, even if the centrifugal switch is operating correctly, the centrifugal switch can allow the heater to operate when the motor is running, even when the drum is not rotating as intended. For example, with a belt drive system, as is common in clothes dryers, if the belt were slipping or broken, the drum would not rotate properly even when the motor is running at the desired speed. In this prior approach, in order to prevent the motor and/or the heater from operating when a belt has broken, a separate "broken belt switch" must be used, which is typically also a mechanical device having moving parts. A further shortcoming with the prior centrifugal switch approach, is that if the motor stalls or is slowed by a heavy drum load, the motor start winding can continue to cycle on and off. This is due to the centrifugal switch having a specific motor shaft rotation speed ("switch actuation speed") that causes the centrifugal switch to actuate; above switch actuation speed, the switch opens, and below the switch actuation speed, the switch closes, for example. Thus, when the motor speed, due to a heavy load, for example, falls slightly below the switch actuation speed, the switch closes and powers the motor start windings; with the additional motor power, the motor speeds up, and the centrifugal switch opens when the motor shaft rotation speed exceeds the switch actuation speed again. With the prior approach, this cycling can continue for many cycles, until the clothes have dried sufficiently that the lower weight allows the drum to rotate more freely; such excessive cycling can shorten the life of the motor or other portion of the clothes dryer such as electrical power components of the clothes dryer. The centrifugal switch and the broken belt switch are mechanical components with moving parts, and have cost, complexity, and reliability issues. One or more mechanical components present in the prior clothes dryers using a centrifugal switch can be eliminated by using the present invention, in which a speed sensor 120, 220 is configured and arranged to sense movement of a portion of the drum assembly 140, 240. By configuring and arranging the speed sensor 120, 220 to sense movement of a portion of the drum assembly 140, 240 (such as the drum 142, 242, the belt 262, the idler 264, the drum support roller 266, or the drum shaft 272) rather than the motor 146, 246 or the motor shaft 270, the speed sensor 120, 220 more accurately senses movement of the drum 142, 242; this overcomes the problem of the drum 142, 242 rotating too slowly or not at all such as due to a broken or slipping belt 262 and potentially causing heat damage to the clothes, even though the motor shaft 270 is rotating normally. In the case of a broken or slipping belt, the prior art approach utilizing a centrifugal switch could result in such heat damage to the clothes since the centrifugal switch could fail to actuate and turn the heater off when the drum is not rotating properly, whereas with the present invention, the speed sensor 120, 220 would sense the lack of movement or the slow movement of the drum 142, 242 and the control circuit 116, 216 would turn off the heater 110, 210. Thus, a separate broken belt switch component is also not required with the present invention. Using the present invention, then, can improve dryer function and reliability, while eliminating some mechanical components, simplifying and reducing the cost of the clothes dryer. Therefore, configuring and arranging the speed sensor 120, 220 to sense movement of a portion of the drum assembly 140, 240 is preferred.

Another advantageous feature of the present invention is that the output 128, 228 of the speed sensor 120, 220 can be a variable output corresponding to the magnitude of the sensed movement of a portion of the drum assembly 140, 240. The control circuit 116, 216 can then control the motor 146, 246 and/or the heater 110, 210 and/or the timer 290, for example, in a variable manner, adjusting the amount of electric power supplied to the motor 146, 246 and/or the heater 110, 210 in order to adjust and control the speed of the motor 146, 246 to achieve or maintain the sensed movement of a portion of the drum assembly 140, 240 in a desired predetermined range, and/or to achieve or maintain the temperature of the heater 110, 210 or the operating temperature 112, 212 in a desired predetermined range, or to adjust the drying cycle by controlling the timer 290. For example, in some embodiments, the variable output 128, 228 of the speed sensor 120, 220 preferably corresponds to the magnitude of the sensed movement of a portion of the drum assembly 140, 240, and the control circuit 116, 216 preferably compares the variable output 128, 228 to a desired predetermined range, and supplies a variable amount of electric power to the motor 146, 246. For example, when the variable output 128, 228 of the speed sensor 120, 220 corresponds to the sensed movement of a portion of the drum assembly 140, 240 that is farther below a predetermined range, the control circuit 116, 216 preferably supplies a greater amount of electric power to the motor 146, 246. In other embodiments, the control circuit 116, 216 preferably adjusts the amount of electric power to the heater 110, 210 (or the amount of fuel for a combustion-type heater) depending on the variable output 128, 228 of the speed sensor 120, 220. This variable control approach can offer better clothes drying performance of the clothes dryer 100, 200 and longer life of the heater 110, 210, the motor 146, 246, or other portion of the drum assembly 140, 240 than an approach of repeatedly cycling the start winding 148, 248 and/or the heater 110, 210. In various embodiments, this variable control approach can offer improved energy efficiency, more uniform energy usage, or improved component reliability due to minimizing any abrupt cycling of electrical or mechanical components. This variable control approach is not available when using the prior centrifugal switch to turn on or turn off the heater, the motor, or the start windings. Various predetermined speed ranges can be utilized for control of the motor 146, 246, the run winding 148, 248, and/or the heater 110, 210, for example, with the speed sensor 120, 220, whether included in the control circuit 116, 216 or separate and distinct from the control circuit, creating an output 128, 228 which enables the control circuit 116, 216 to control the motor 146, 246, the run winding 148, 248, and/or the heater 110, 210 appropriately. For example, the control circuit 116, 216 can control the motor 146, 246 or the run winding 148, 248 to maintain the sensed speed in the desired predetermined range.

A heavier dryer load, such as when the load contains a great amount of water, or when there is a large amount of material in the dryer, may cause a slower speed of rotation of the drum (and other portions of the drum assembly, for example). In addition, the acceleration of the drum (such as during start-up) will be slower. Another useful aspect of the present invention is that the dryer load size, and the progress of drying, can be determined by monitoring the output 128, 228 of the speed sensor 120, 220; the control circuit 116, 216 can then control a portion of the clothes dryer 100, 200 accordingly, as described herein.

Figure 3:
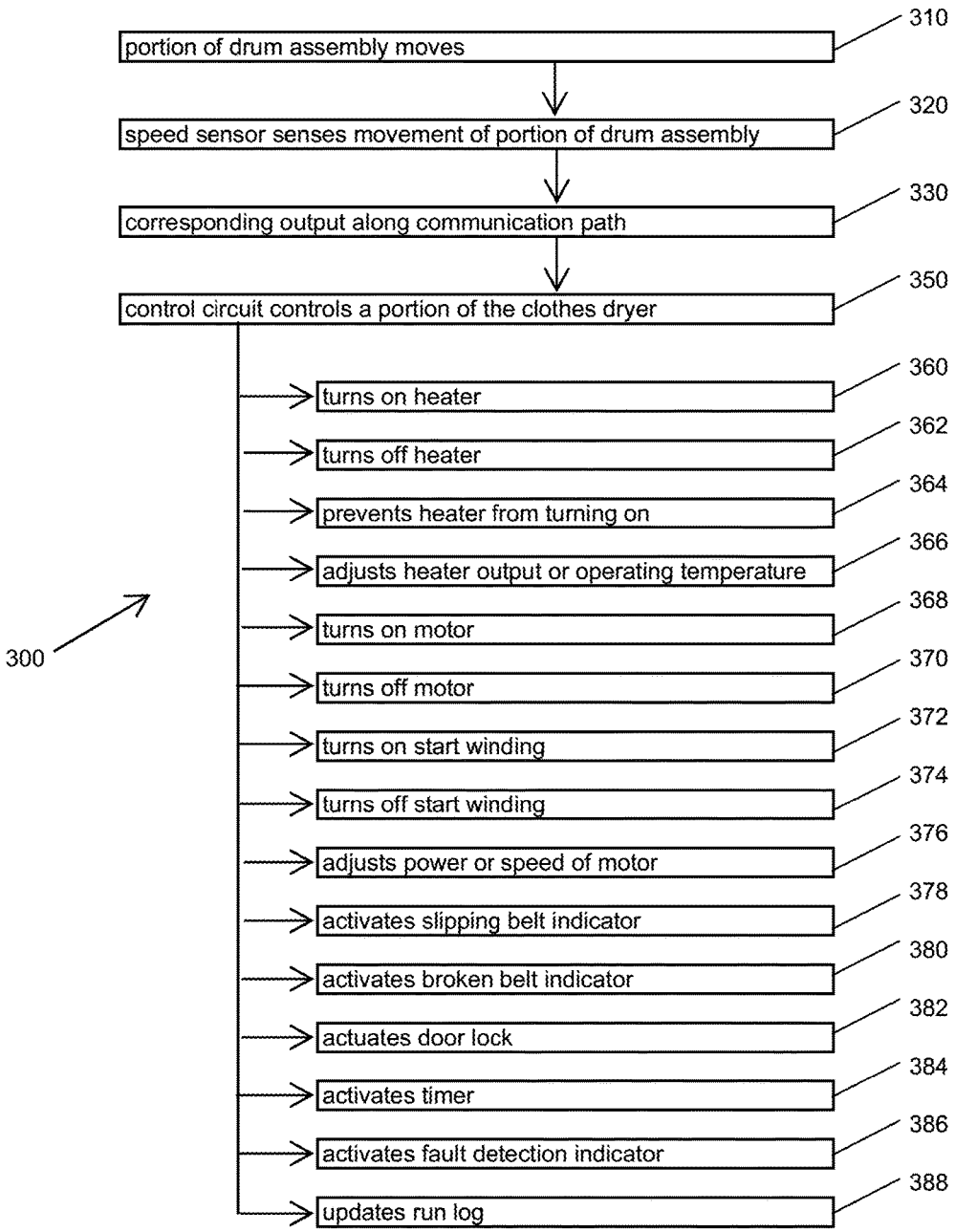
FIG. 3 is a flow diagram illustrating how the speed sensor of FIG. 1B facilitates control of a selected element of a clothes dryer.

FIG. 3 is a flow diagram illustrating how the speed sensor 120, 220 senses movement of a portion of the drum assembly 140, 240, and the corresponding output 128, 228 is communicated via communication path 132,232, and the control circuit 116, 216 controls a portion of the clothes dryer 100, 200 accordingly. FIG. 3 shows that when portion of the drum assembly moves 310, the speed sensor senses movement of the portion of drum assembly 320, the corresponding output is communicated along the communication path 330, and the control circuit controls a portion of the clothes dryer 350. The particular control of a portion of the clothes dryer can be, for example, any of: turns on heater 360, turns off heater 362, prevents heater from turning on 364, adjusts output of heater or operating temperature 366, turns on motor 368, turns off motor 370, turns on start winding 372, turns off start winding 374, adjusts power or speed of motor 376, activates slipping belt indicator 378, activates broken belt indicator 380, actuates door lock 382, activates timer 384, activates fault detection indicator 386, updates run log 388.

Figure 4A:
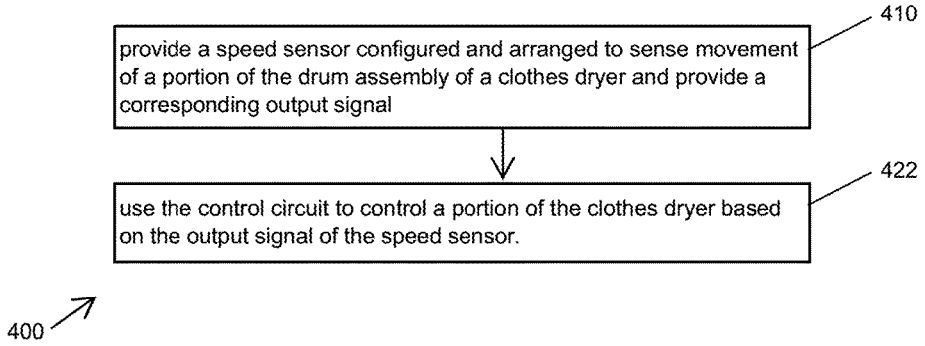
FIG. 4A is a flow diagram illustrating an example embodiment of the present invention including a method of controlling a selected element of clothes dryer.

FIG. 4A is a flow diagram illustrating an example embodiment of the present invention, in which a process for controlling a portion of a clothes dryer 400 preferably includes steps of providing a speed sensor configured and arranged to sense movement of a portion of the drum assembly of a clothes dryer and provide a corresponding output signal 410, and using the control circuit to control a portion of the clothes dryer based on the output signal of the movement sensor 422.

Figure 4B:
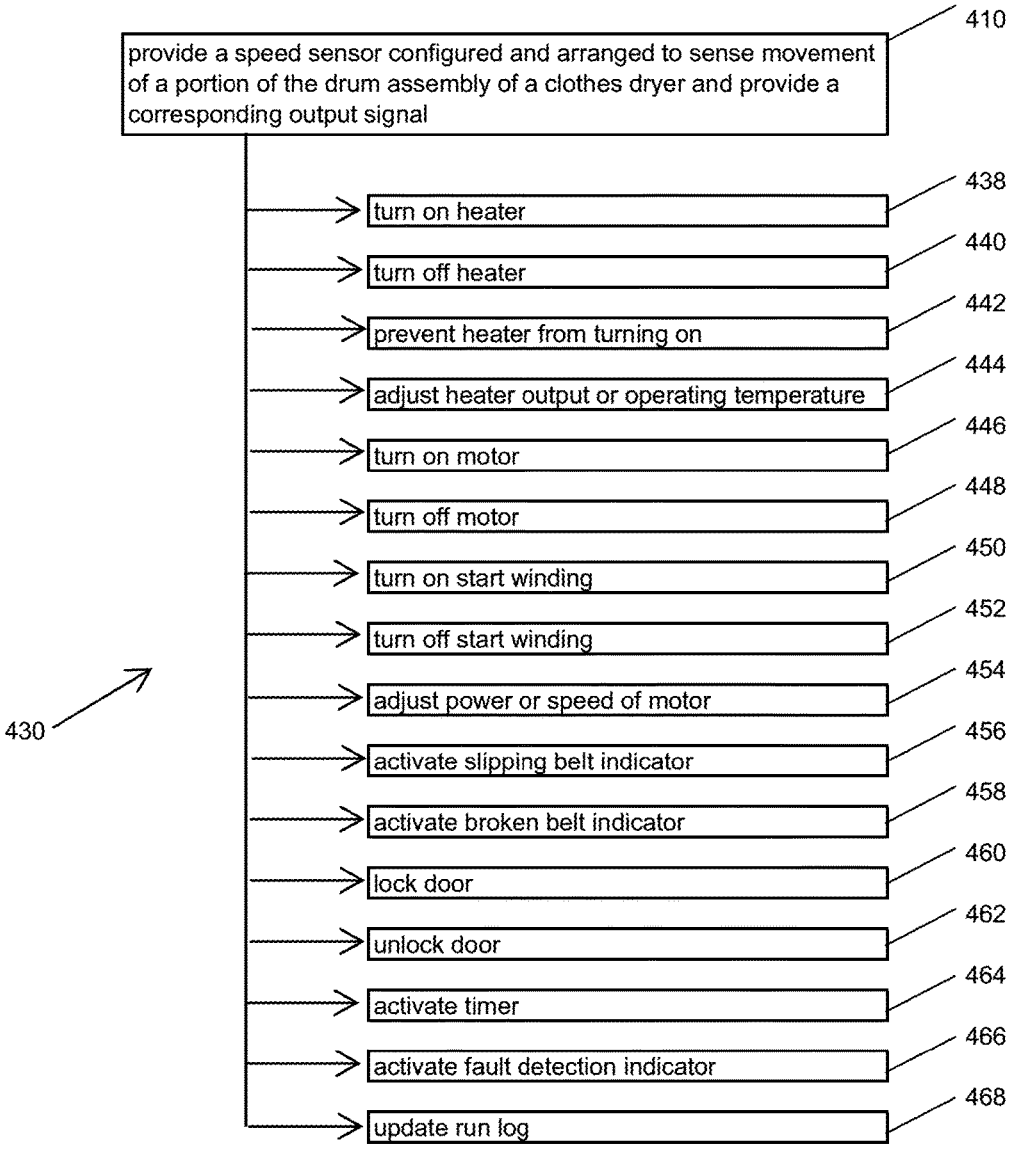
FIG. 4B is a flow diagram illustrating additional example embodiments of the present invention including methods of controlling a selected element of a clothes dryer.

FIG. 4B is a flow diagram illustrating additional example embodiments of the present invention in which a process for controlling a portion of a clothes dryer 430 preferably includes steps of providing a speed sensor configured and arranged to sense movement of a portion of the drum assembly of a clothes dryer and provide a corresponding output signal 410, and preferably includes one or more steps of turning on a heater 438, turning off a heater 440, preventing a heater from turning on 442, adjusting the output of a heater or operating temperature 444, turning on a motor 446, turning off a motor 448, turning on a start winding 450, turning off a start winding 452, adjusting the power or speed of a motor 454, activating a slipping belt indicator 456, activating a broken belt indicator 458, locking a door 460, unlocking a door 462, activating a timer 464, activating a fault detection indicator 466, and updating a run log 468.

Figure 4C:
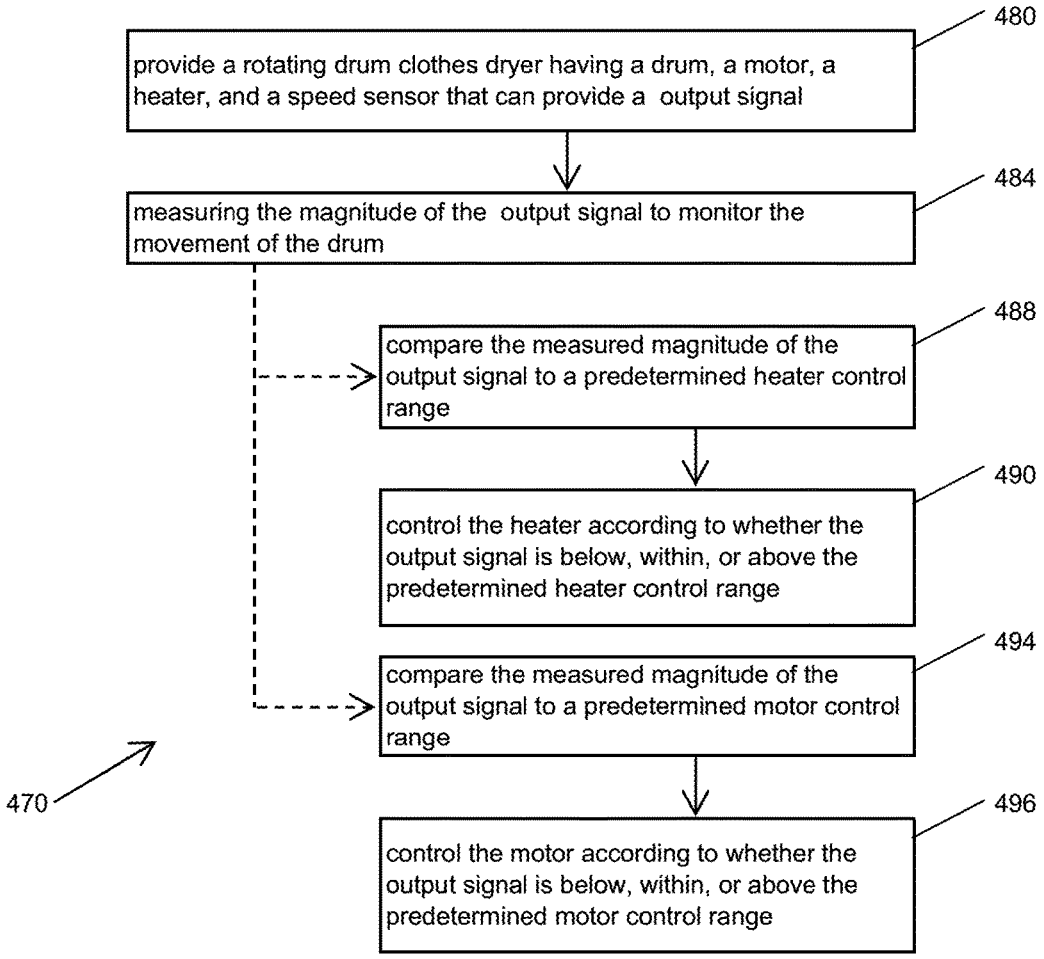
FIG. 4C is a flow diagram illustrating a further example embodiment of the present invention including a method of monitoring the movement of a selected portion of the drum assembly of a clothes dryer.

FIG. 4C is a flow diagram illustrating another example embodiment of the present invention, in which a process for monitoring the movement of the drum of a clothes dryer 470 preferably includes steps of provide a rotating drum clothes dryer having a drum, a motor, a heater, and a speed sensor that can provide an output signal 480, and measuring the magnitude of the output signal to monitor the movement of the drum 484. In some embodiments the method further includes the steps of comparing the measured magnitude of the output signal to a predetermined heater control range 488 and controlling the heater according to whether the magnitude of the output signal is below, within, or above the predetermined heater control range 490. In some embodiments the method further includes the steps of comparing the measured magnitude of the output signal to a predetermined motor control range 494 and controlling the motor according to whether the output signal is below, within, or above the predetermined motor control range 496.

Figure 5:
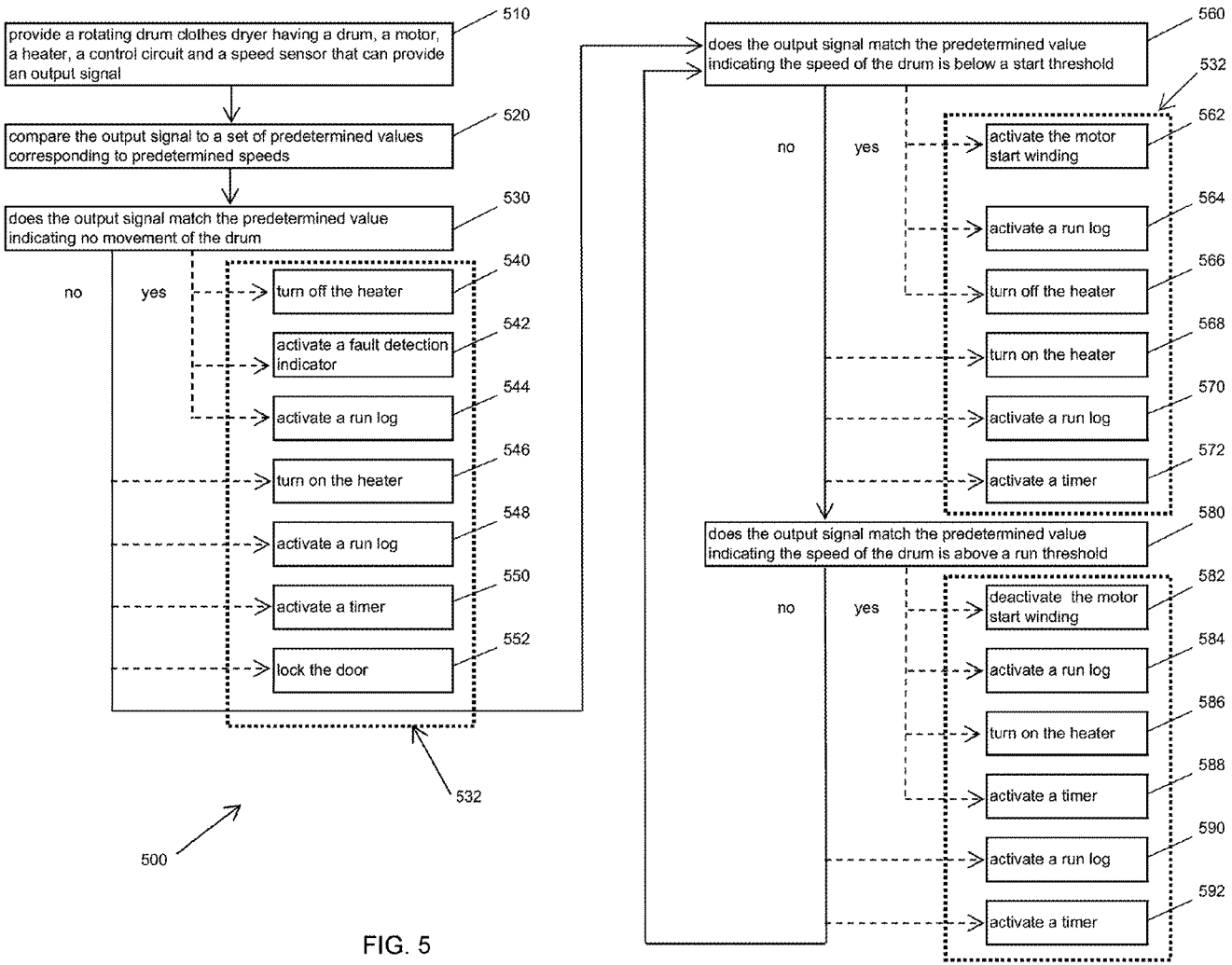
FIG. 5 is a flow diagram illustrating other example embodiments of the present invention including methods using a speed sensor to control a selected element of a clothes dryer.

FIG. 5 is a flow diagram illustrating other example embodiments of the present invention. In simple terms, these processes include the steps of providing a rotating drum clothes dryer having a drum, a motor, a heater, a control circuit and a speed sensor that can provide an output signal, comparing the output signal to a set of predetermined values corresponding to predetermined speeds, determining whether the output signal matches the predetermined value indicating no movement of the drum, or the predetermined value indicating the speed of the drum is below a start threshold, or the predetermined value indicating the speed of the drum is above a run threshold, and then controlling a portion of the clothes dryer according to the result of that comparison. For simplicity here, when we say "predetermined value" we mean this to include either a single value, or a range of values; therefore, there may be 3 predetermined values in this example process, or 3 predetermined non-overlapping ranges of values, or a combination of single values and ranges. Further, the particular controlling steps 540-552, 562-572, 582-592 are not necessarily required, but are given as examples of controlling a portion of the clothes dryer 532. In further detail, a process for controlling a portion of a clothes dryer 500 preferably includes the steps of providing a rotating drum clothes dryer having a drum, a motor, a heater, a control circuit and a speed sensor that can provide an output signal 510, comparing the output signal to a set of predetermined values corresponding to predetermined speeds 520, controlling a portion of the clothes dryer 532, determining whether the output signal matches the predetermined value indicting no movement of the drum 530, if yes then optionally turning off the heater 540, activating a fault detection indicator 542, or activating a run log 544, if no then optionally turning on the heater 546, activating a run log 548, activating a timer 550, or locking the door 552, determining whether the output signal matches the predetermined value indicating the speed of the drum is below a start threshold 560, if yes then optionally activating the motor start winding 562, activating a run log 564, or turning off the heater 566, if no then optionally turning on the heater 568, activating a run log 570, or activating a timer 572, determining whether the output signal matches the predetermined value indicating the speed of the drum is above a run threshold 580, if yes then optionally deactivating the motor start winding 582, activating a run log 584, turning on the heater 586, or activating a timer 588, if no then optionally activating a run log 590 or activating a timer 592, and returning to the step of determining whether the output signal matches the predetermined value indicating the speed of the drum is below a start threshold 560.

Embodiments combining various features of the example embodiments illustrated and described can be combined to obtain other useful embodiments. In preferred embodiments, many of the process steps can be re-ordered to obtain still other useful embodiments. Various modifications can be made to the present invention without departing from the apparent scope thereof.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A rotating drum clothes dryer, comprising:

a drum assembly, the drum assembly including a drum, the drum being rotatable, a motor, the motor being constructed and arranged to rotate the drum;

a heater;

a control circuit; and a speed sensor constructed and arranged to:

1) sense whether a portion of the drum assembly is moving at a speed of movement that is selected from the group consisting of 1) a first speed at or above a first predetermined speed threshold; and 2) a second speed below the first predetermined speed threshold; wherein the portion of the drum assembly is selected from the group consisting of the drum, a belt, an idler, a drum support roller, a drum bearing, a drum shaft, a belt tensioning roller and a sensor tag; and 2) create an output signal to the control circuit that indicates whether the selected portion of the drum assembly is moving at a speed selected from the group consisting of the first speed and the second speed; wherein the control circuit is constructed and arranged to control the operation an element of the clothes dryer selected from the group consisting of the motor, the heater, a door lock, a visual indicator, an audible indicator, a timer and a fault detection indicator.

2. The rotating drum clothes dryer of claim 1, wherein the motor includes a run winding and a start winding; wherein the speed sensor has an output signal that is an electrical signal and the motor includes a run winding and a start winding; wherein the control circuit is constructed and arranged to supply electrical power to the run winding and the start winding when the speed sensed by the speed sensor is the second speed; and the control circuit is constructed and arranged to supply electrical power to the run winding, but not to the start winding, when the speed sensed by the speed sensor is the first speed.

3. The rotating drum clothes dryer of claim 1, wherein:

the motor requires an electrical power input; and the control circuit is constructed and arranged to provide a variable electrical power input to the motor; wherein the speed sensor can sense a magnitude of a third speed of the portion of the drum assembly and create a variable output signal to the control circuit that corresponds to the magnitude of the third speed; wherein the control circuit is constructed and arranged to vary the electrical power provided to the motor so as to provide sufficient electrical power to the motor to keep the third speed within a predetermined range.

4. The rotating drum clothes dryer of claim 1, wherein the control circuit is constructed and arranged to turn on the heater when the speed of movement is the first speed; wherein the control circuit is constructed and arranged to turn off the heater when the control circuit senses that the selected portion of the drum assembly is moving at a third speed that falls below a second predetermined speed threshold which is below the first speed threshold.

5. The rotating drum clothes dryer of claim 1, wherein the control circuit is constructed and arranged such that, when the speed sensed by the speed sensor is the second speed, the control circuit initiates an action selected from the group consisting of turning on a broken belt indicator, turning on a slipping belt indicator, turning off the heater, disabling a switch for turning the heater on so that the heater cannot be turned on and turning off the motor.

6. The rotating drum clothes dryer of claim 1, wherein the speed sensor is selected from the group consisting of a solid-state sensor, an optical sensor, a magnetic sensor, and a mechanical sensor.

7. The rotating drum clothes dryer of claim 1, wherein the heater is selected from the group consisting of an electrical resistance heater and a combustion heater.

8. The rotating drum clothes dryer of claim 1, wherein the selected portion of the drum assembly is moving at the first speed; wherein the speed sensor is constructed and arranged to sense the movement of the selected portion of the drum assembly and create a variable electrical output signal.

* * * * *